US006126272A

United States Patent [19]

Ahn

[11] Patent Number: 6,126,272

[45] Date of Patent: Oct. 3, 2000

[54] INK SPRAYING DEVICE FOR PRINT HEAD

[75] Inventor: Byung-sun Ahn, Suwon-si, Rep. of Korea

[73] Assignee: SamSung Electronics Co., Ltd., Kyungki-do, Rep. of Korea

[21] Appl. No.: 09/007,821

[22] Filed: Jan. 15, 1998

[30] Foreign Application Priority Data

Jan. 15, 1997 [KR] Rep. of Korea ..... 97-959

[51] Int. Cl.[7] ..... B41J 2/05

[52] U.S. Cl. ..... 347/54; 29/890.1; 216/27; 347/63

[58] Field of Search ..... 347/54, 63, 65; 216/27; 29/890.1

[56] References Cited

U.S. PATENT DOCUMENTS

| | | | |
|---|---|---|---|
| 4,353,078 | 10/1982 | Lee et al. . | |
| 4,480,259 | 10/1984 | Kruger et al. | 347/63 |
| 4,513,298 | 4/1985 | Scheu . | |
| 4,580,148 | 4/1986 | Domoto et al. . | |
| 4,716,423 | 12/1987 | Chan et al. | 347/65 |
| 4,942,408 | 7/1990 | Braun . | |
| 5,153,610 | 10/1992 | Komuro et al. . | |
| 5,364,743 | 11/1994 | O'Neill . | |
| 5,463,411 | 10/1995 | Wehl . | |
| 5,467,112 | 11/1995 | Mitani . | |
| 5,515,085 | 5/1996 | Hotomi et al. . | |
| 5,539,437 | 7/1996 | Penwell . | |
| 5,684,519 | 11/1997 | Matoba et al. . | |
| 5,718,044 | 2/1998 | Baughman et al. | 29/890.1 |
| 5,809,646 | 9/1998 | Reinecke | 29/890.1 |

FOREIGN PATENT DOCUMENTS

| | | |
|---|---|---|
| 62-37163 | 2/1987 | Japan . |
| 2-111549 | 4/1990 | Japan . |
| 2-179748 | 7/1990 | Japan . |
| 6-87213 | 3/1994 | Japan . |
| 8-118632 | 5/1996 | Japan . |

*Primary Examiner*—Joan Pendegrass
*Attorney, Agent, or Firm*—Robert E. Bushnell, Esq.

[57] ABSTRACT

An ink spraying device, having an ink heating portion for producing thermal energy in accordance with an applied electric energy, includes an ink spraying portion, assembled onto the ink heating portion, for ejecting received ink through a nozzle plate in accordance with the produced thermal energy. An ink chamber of the ink spraying portion is pre-aligned with respect to the nozzle plate, and the ink spraying portion is fixed onto the ink heating portion, using high-temperature, high-pressure bonding. The manufacturing process for forming the ink spraying device, for a print head proceeds normally for the ink heating portion thereof, but is performed separately for the manufacture of the ink spraying portion thereof. By manufacturing the ink spraying portion separately, the ink chamber can be integrally formed with the nozzle plate, as a unified workpiece, so that the assembly offset is virtually zero and productivity is enhanced.

22 Claims, 10 Drawing Sheets

INK SPRAYING DEVICE FOR PRINT HEAD

CLAIM OF PRIORITY

This application makes reference to, incorporates the same herein, and claims all benefits accruing under 35 U.S.C. §119 from my application entitled Ink Spraying Device for Print Head filed with the Korean Industrial Property Office on Jan. 15, 1997 and there duly assigned Ser. No. 97-00959 by that Office.

BACKGROUND OF THE INVENTION

1. Field of the Invention

The present invention relates to an ink spraying device for a print head and, more particularly, to a device for receiving ink stored in an ink-jet print head and spraying the supplied ink when electric energy is applied.

2. Discussion of Related Art

A printing apparatus using ink performs printing by spraying ink stored in its print head through an ink spraying device. The ink spraying device receives the ink stored in the print head and ejects it onto paper when electric energy is applied. This kind of device includes a type using a membrane layer separating a heating chamber and an ink chamber.

A conventional ink spraying device using such a membrane layer is integrally formed with an ink spraying chip. The chip is made by forming a plurality of heating chambers on a silicon substrate, forming a membrane layer (which may include more than one membrane) on the heating chambers, and then forming a plurality of ink chambers on the membrane layer. A nozzle plate is then fixed to the thus-formed chip to complete the assembly.

To fix the nozzle plate to the ink spraying chip, the ink chambers of the chip and the nozzles of the plate must be precisely aligned using an alignment key formed on the chip's surface and carefully viewed through a microscope. In doing so, human error is introduced, causing an offset which impedes the advance of ink droplets out through the nozzle and thus diminishes the sharpness of the printing result. Therefore, a precision assembly step is required in aligning the nozzle plate with the ink spraying chip, which hinders productivity. For example, if the misalignment exceeds a maximum tolerance of ±1 $\mu$m, the assembly is deemed defective.

SUMMARY OF THE INVENTION

Therefore, in order to overcome such drawbacks of the prior art, an objective of the present invention is to provide an ink spraying device for a print head, separately manufactured into an ink heating portion and ink spraying portion to facilitate assembly.

It is another objective of the present invention to provide an ink spraying device for a print head in which the relative position of the nozzle of the nozzle plate is fixed with respect to the ink chamber, prior to final assembly, so that alignment errors are eliminated.

In the above ink spraying device, which receives ink stored in a print head and ejecting the ink when an electric energy is applied, an ink heating portion produces thermal energy in accordance with the applied electric energy, and an ink spraying portion, to be assembled onto the ink heating portion, ejects the received ink in accordance with the produced thermal energy.

The manufacturing process for forming the ink spraying device for a print head according to the present invention proceeds normally for the ink heating portion thereof, but is performed separately for the manufacture of the ink spraying portion thereof. By manufacturing the ink spraying portion separately, the ink chamber can be integrally formed with the nozzle plate, as a unified workpiece, so that the assembly offset is virtually zero.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF PREFERRED EMBODIMENT

An embodiment of the ink spraying device of a print head of the present invention largely comprises: an ink heating portion (see FIG. 14) for generating thermal energy when electric energy is applied and thereby heating a heating fluid; and an ink spraying portion (see FIG. 26), assembled onto the ink heating portion in alignment therewith, for ejecting temporarily stored ink in accordance with the generated thermal energy.

Figure 1:
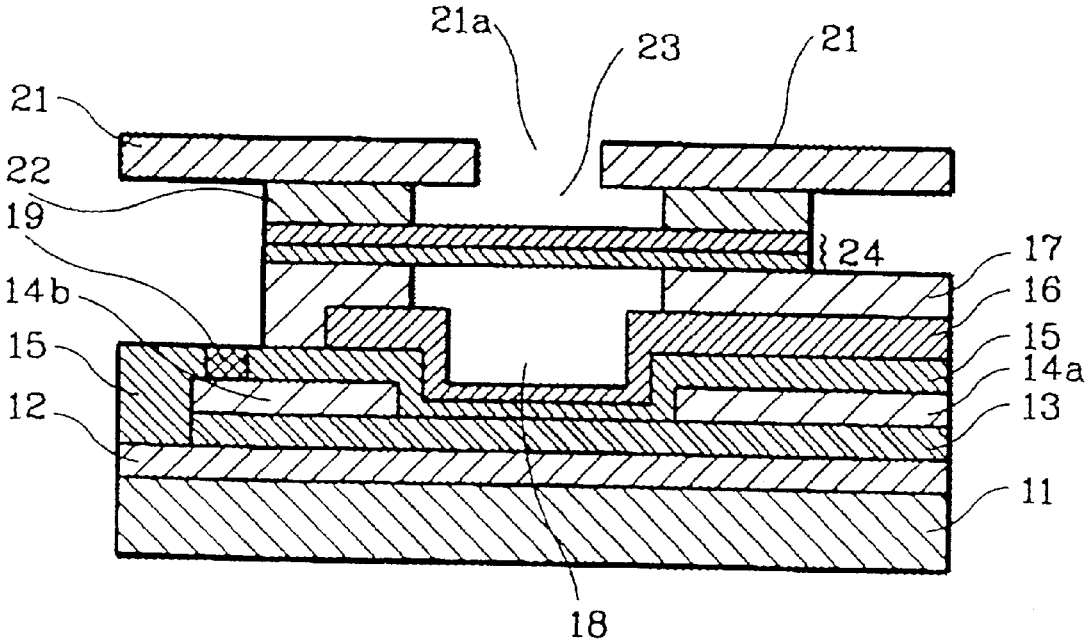
FIG. 1 is a sectional view of an ink spraying device for a print head according to the present invention.

Referring to FIG. 1, the ink heating portion includes a substrate 11, a protective layer 12 for protecting the surface of the substrate 11, a heating layer 13 selectively formed on the protective layer 12 for generating heat in accordance with an applied electric energy, a pair of electrodes 14*a* and 14*b* in contact with the heating layer 13 in order to supply electric energy thereto, first and second passivation layers 15 and 16 for protecting the interior from being damaged by the generated heat, an electrical contact 19 for providing external selective connection to one electrode (the other electrode being part of the common electrode), and a heating chamber barrier 17 defining a heating chamber 18.

The ink spraying portion includes a nozzle plate 21 having an opening 21*a* through which ink droplets are ejected, an ink chamber barrier 22 defining an ink chamber 23, and a plurality of membranes 24 formed over the ink chamber barrier 22 for receiving the thermal energy produced by the ink heating portion in order to form and eject the ink droplets. It should be appreciated that such a structure forms a unified subassembly incorporating both the heating chamber and nozzle plate, which are preformed using photolithographic techniques such that their relative positioning is fixed without any step for manual alignment.

A manufacturing procedure of the thus-constructed ink spraying device will now be described, beginning with the ink heating portion.

Figure 2:
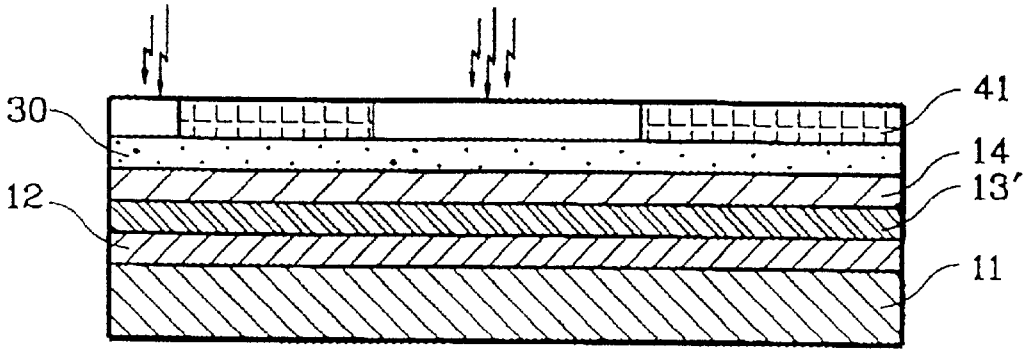
FIGS. 2–14 are cross-sectional side views showing the process, in sequence, for forming the ink heating portion of the device shown in FIG. 1.

Referring to FIG. 2, silicon dioxide ($SiO_2$) is formed on the substrate 11 to produce the protective layer 12. Then, a resistive material 13' used to form the heating layer 13 is deposited on the protective layer 12, and a conductive material used to form the electrode layer 14 is deposited on the heating layer. Here, the electrode layer 14 is made up of an aluminum sputtering deposition atop a tantalum-aluminum alloy layer formed to a predetermined thickness, the result of which is then patterned.

Figure 3:
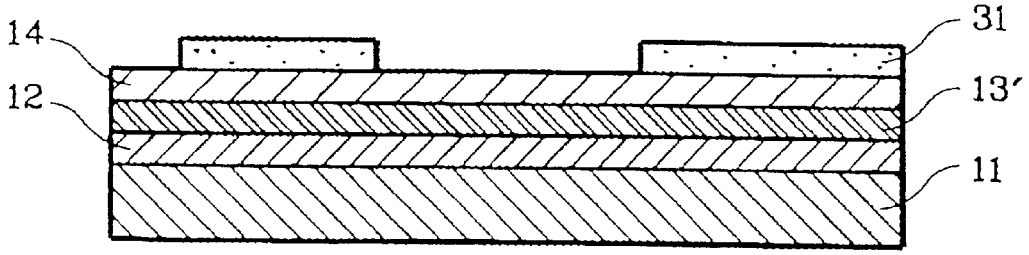
Figure 4:
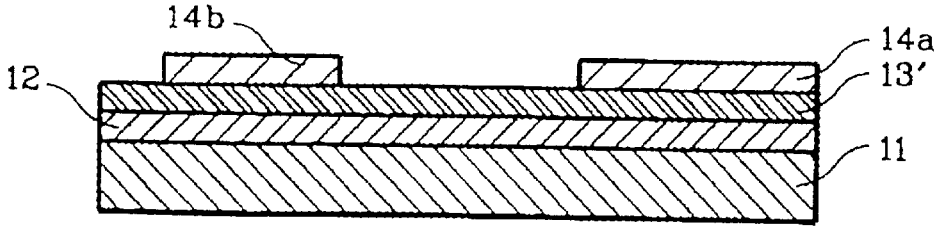

In the patterning process, a photoresist material 30 is coated on the electrode layer 14 followed by a planarization step, and then a first mask 41 for forming the electrode pattern is laid on the planarized photoresist. With the first mask 41 in place, the photoresist material 30 is exposed to ultraviolet light to react therewith. In this embodiment, a positive photoresist is used so that the developed photoresist is removed, creating a first photoresist pattern 31 as shown in FIG. 3, and the electrode layer 14 is then dry-etched into electrodes 14*a* and 14*b* as, shown in FIG. 4.

Figure 5:
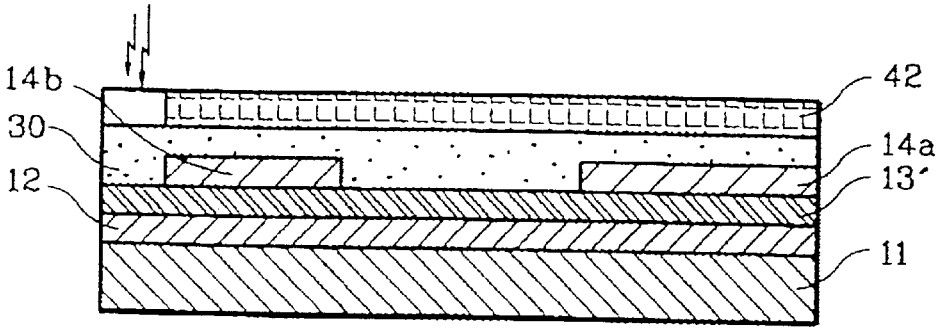
Figure 6:
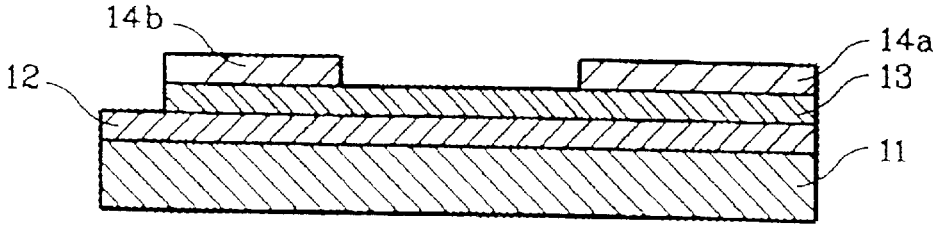

Next, the photoresist material 30 is coated on the patterned electrode layer, and a second mask 42 for forming the heating layer pattern is attached to the planarized surface thereof, as shown in FIG. 5. As shown in FIG. 6, the heating layer 13 is formed through an exposure and development process, similar to that described above, followed by a further etching step.

Figure 7:
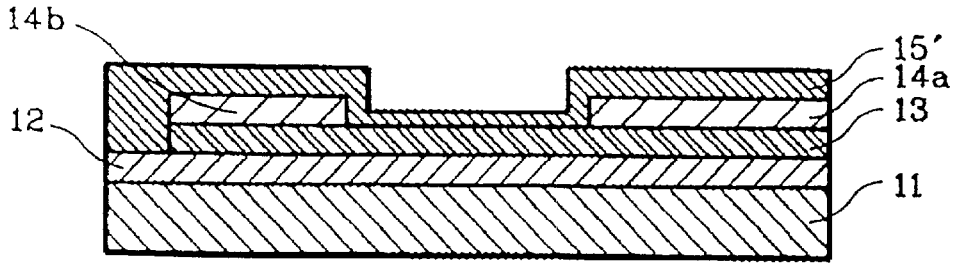

On the resulting structure of the patterned electrodes and heating layer, a layer 15' of silicon nitride ($Si_3N_4$), silicon carbide (SiC) or tantalum is used to form the first passivation layer 15, as shown in FIG. 7. Here, a chemical vapor deposition process may be used.

Figure 8:
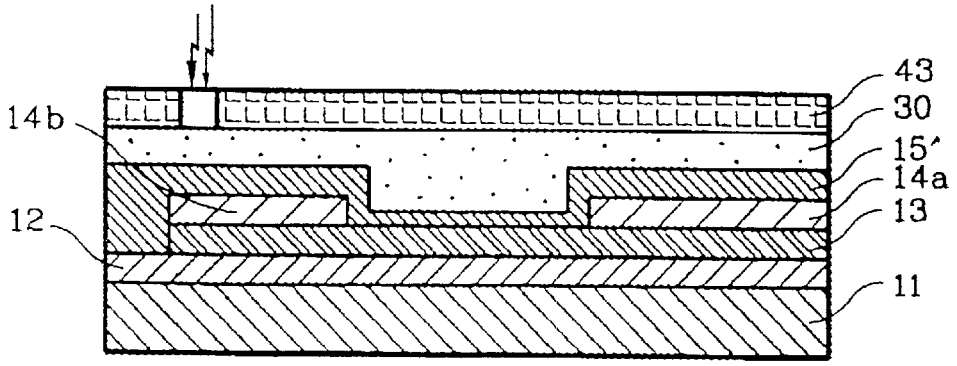
Figure 9:
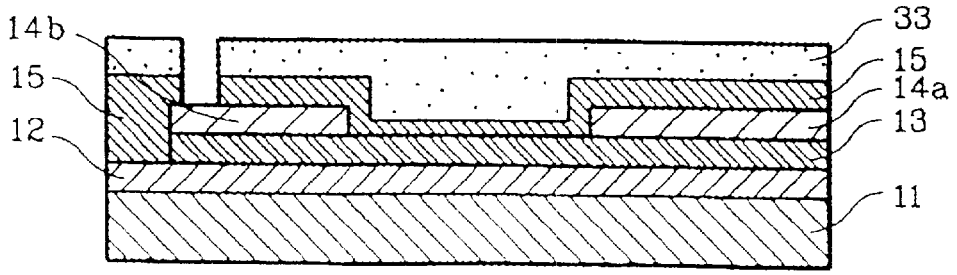
Figure 10:
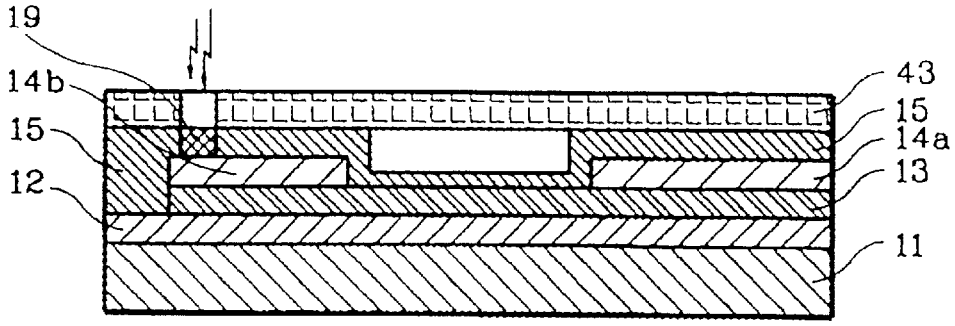
Figure 11:
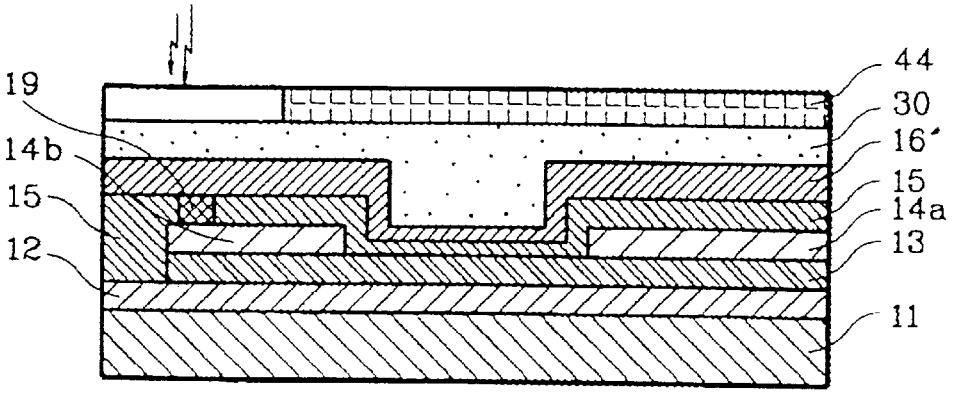
Figure 12:
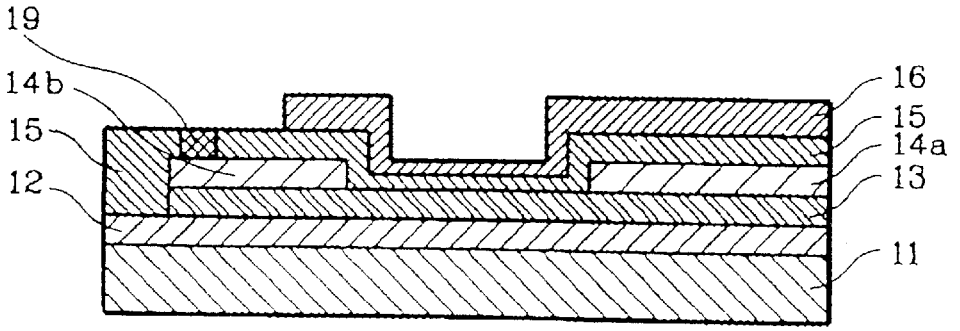

Then, in order to form the electrical contact 19, photoresist material 30 is again coated and planarized and a third mask 43 is placed. thereon as shown in FIG. 8. As shown in FIG. 9, the subsequent exposure and development process produces a photoresist pattern 33 for etching the first passivation layer to form, a contact via therein. After the removal of the photoresist, the third mask 43 is replaced and gold, i.e., a highly conductive material, is used to form the electrical contact 19, as shown in FIG. 10. A tantalum layer 16' is deposited on the resulting structure. Thereafter a patterning process similar to that described above, using a planarized surface of the photoresist material 30 and a fourth mask 44 as shown in FIG. 11, is used to form, the second passivation layer 16 and thereby expose the electrical contact 19 as shown in FIG. 12.

Figure 13:
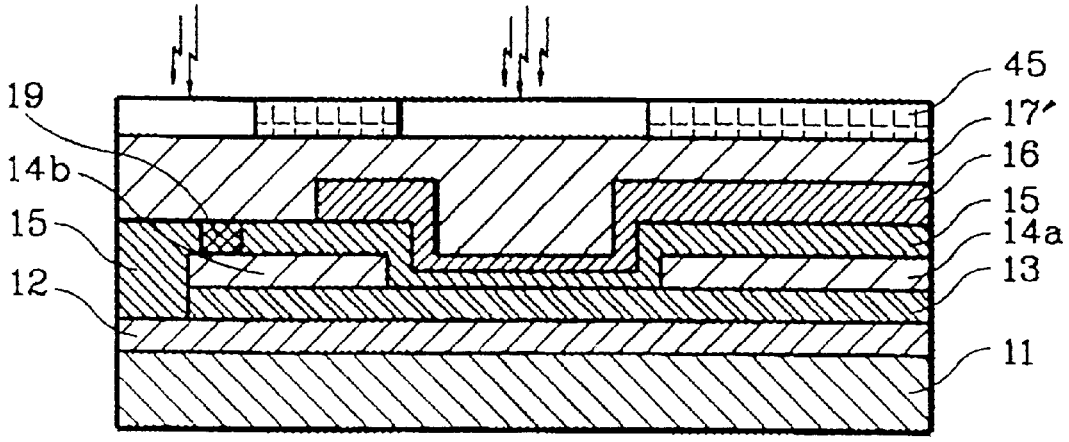
Figure 14:
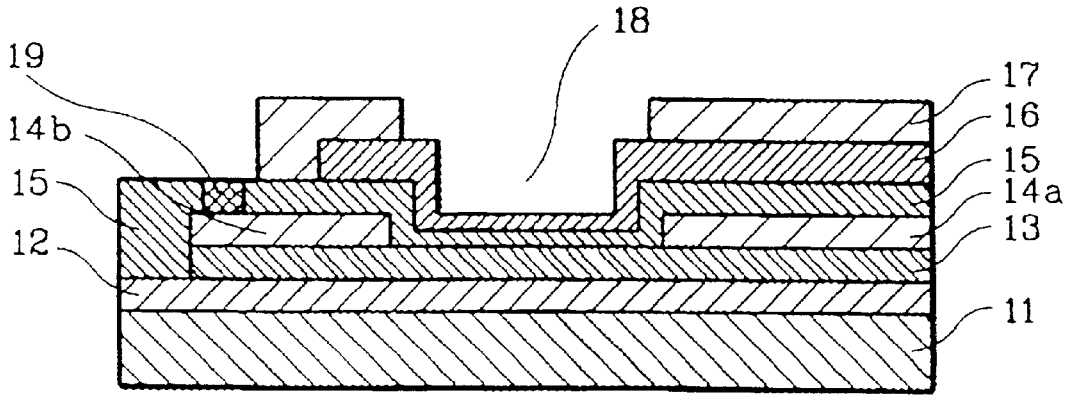

The formation of the heating chamber 18 is accomplished through the deposition of a photopolymer layer 17' on the passivation layers 15 and 16, to a thickness determinant of the chamber's size. As shown in FIG. 13, a fifth mask 45 having the pattern of the heating chamber barrier 17 is placed atop the planarized photopolymer surface which has photosensitive properties like the photoresist. Thus, by exposure to ultraviolet light and a corresponding etching process, the heating chamber barrier 17 is formed, as shown in FIG. 14, to thereby define the heating chamber 18. This completes the manufacturing process of the ink heating portion.

Now, a manufacturing procedure of the above-mentioned ink spraying portion for assembly to the ink heating portion above described, will be described in connection with FIGS. 15–26.

Figure 15:
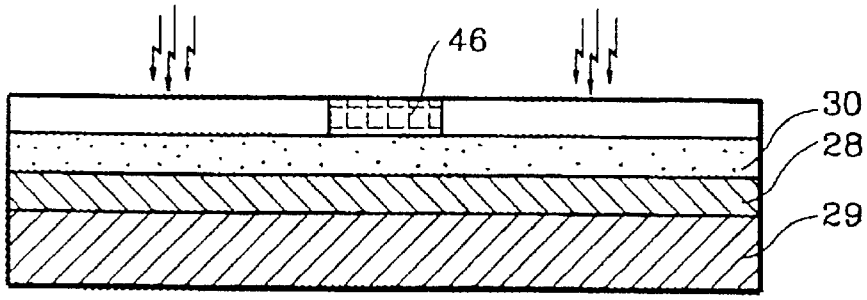
FIGS. 15–26 are cross-sectional side views showing the process, in sequence, for forming the ink spraying portion of the device shown in FIG. 1.
Figure 16:
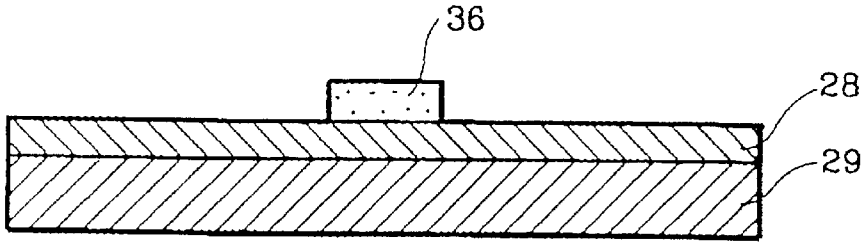
Figure 17:
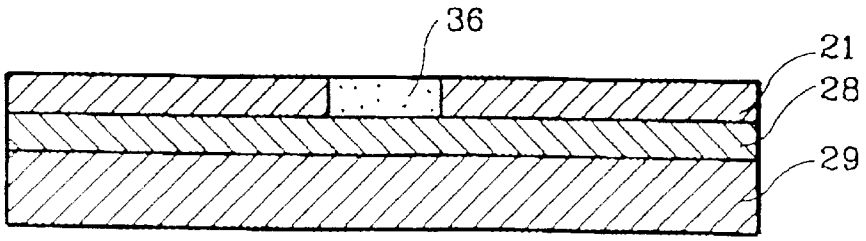
Figure 18:
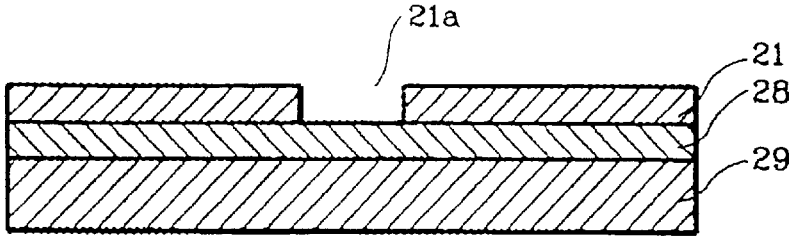

As shown in FIG. 15, an oxide layer 28 is formed on a polished substrate 29 and a photoresist material 30 is coated thereon. Using a sixth mask 46 having the pattern of the heating chamber barrier 17, a photoresist pattern 36 is formed as shown in FIG. 16. An electroplating process is then performed using the material of the nozzle plate 21, e.g., nickel, as shown in FIG. 17, and the pattern 36 is removed to create an opening 21 a, i.e., nozzle, as shown in FIG. 18.

Figure 19:
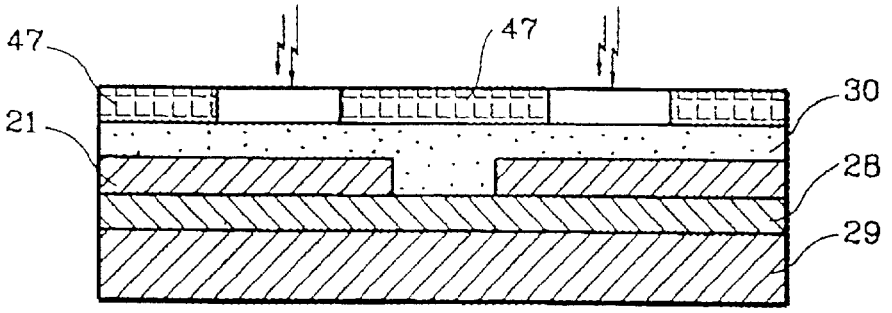
Figure 20:
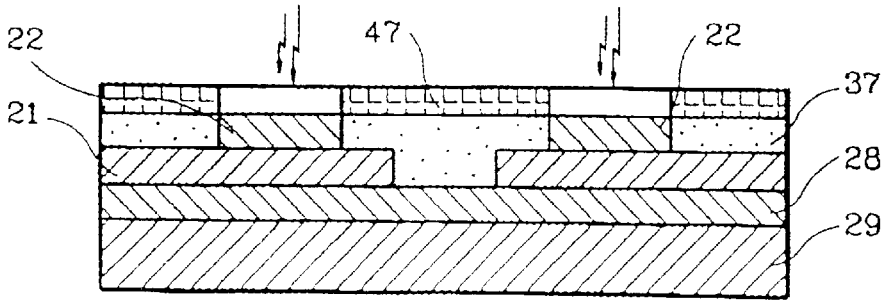
Figure 21:
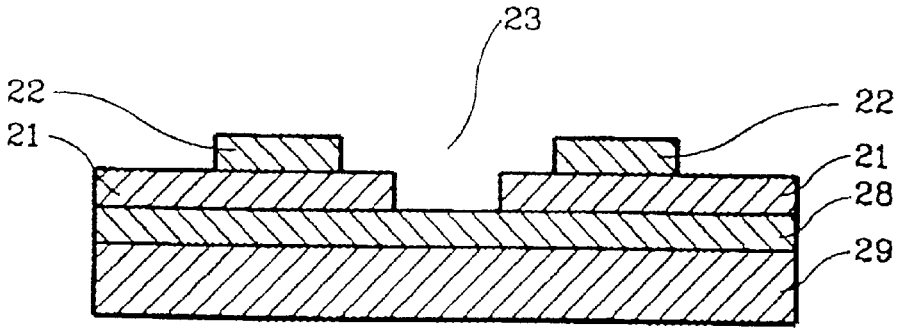

Using a seventh mask 47 having the pattern of the ink chamber barrier 22 laid atop a planarized surface of the photoresist 30 as shown in FIG. 19, a photoresist pattern 37 is formed and, using the same mask again as shown in FIG. 20, a polyamide deposition is performed to give the structure of FIG. 21 showing the ink chamber barrier 22 defining the ink chamber 23.

Figure 22:
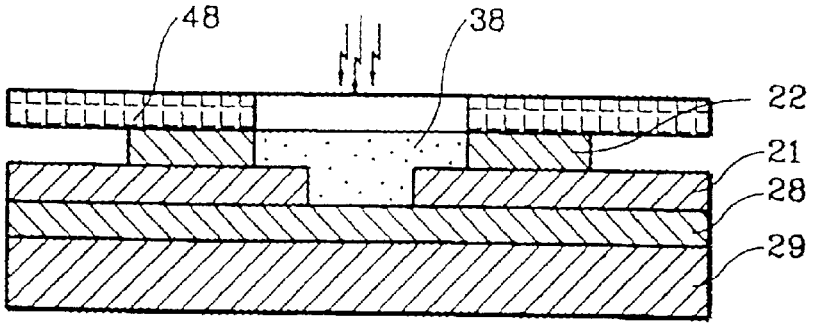

An eighth mask 48 having the pattern of the interior of the ink chamber 23 is placed atop the ink chamber barrier 22 and coated with photoresist material 38 so to form a support mechanism for the subsequent processing, as shown in FIG. 22. Here, though the material used is inconsequential, photoresist is employed due to its relative ease of removal.

Figure 23:
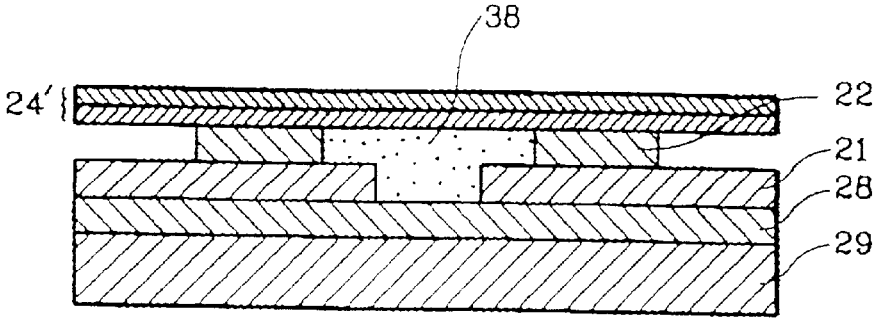
Figure 24:
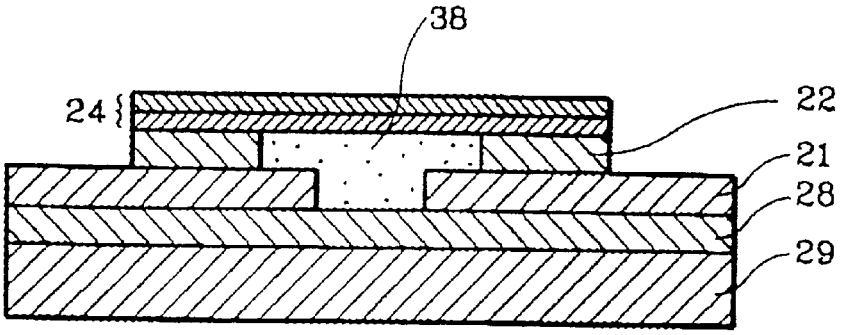

Next, a plurality of membrane layers 24' are individually applied, as in FIG. 23, and patterned to form a plurality of membranes 24, as in FIG. 24, using the same mask (not shown) for each layer one of the plurality of membranes of the membrane layer forming an enclosing surface of the heating chamber and another of the plurality of membranes of the membrane layer forming an enclosing surface of the ink chamber, as illustrated in FIG. 1, for example. Here, the material of each membrane layer or membrane has a different coefficient of thermal expansion.

Figure 25:
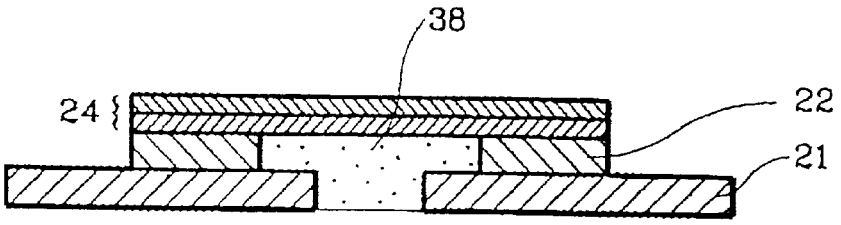
Figure 26:
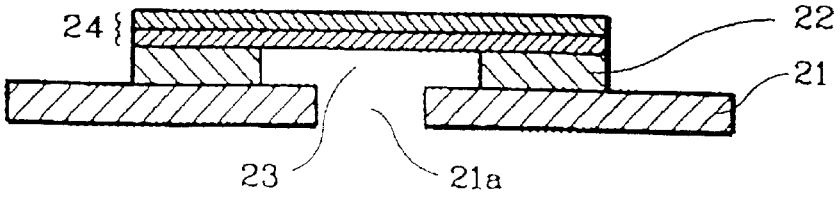

Finally, the substrate layers 28 and 29, having performed their purpose, are lifted off as in FIG. 25 and the membrane support mechanism of photoresist material 38 is removed as in FIG. 26. Here, the layer in contact with the nozzle plate 21 can be easily detached therefrom since nickel is weak in adhesion. This completes the manufacture of the ink spraying portion.

Thus, the separate manufacture of the ink heating portion and the ink spraying portion are concluded. To assemble the two parts, a high-temperature, high-pressure bonding technique is used to join the heating chamber barrier 17 of the ink heating portion with the membranes 24 of the ink spraying portion, to create a seal over the heating chamber 18. This allows for assembly tolerances of up to several micrometers, since the alignment tolerance of the nozzle with the ink chamber is rendered moot.

It will be apparent to those skilled in the art that various modifications can be made in the ink spraying device for a print head of the present invention, without departing from the spirit of the invention. Thus, it is intended that the present invention cover such modifications, as well as variations thereof, within the scope of the appended claims and their equivalents.

What is claimed is:

1. An ink spraying device, comprising:

a separately formed ink heating portion including a heating chamber, said separately formed ink heating portion producing thermal energy in accordance with an applied electric energy; and a separately formed ink spraying portion including an ink chamber said separately formed ink spraying portion being assembled onto said separately formed ink heating portion, said separately formed ink spraying portion including a membrane layer formed of a plurality of membranes to separate said heating chamber from said ink chamber to form and eject ink droplets through a nozzle plate in accordance with the produced thermal energy, one membrane of said plurality of membranes of said membrane layer forming an enclosing surface of said heating chamber and another membrane of said plurality of membranes of said membrane layer forming an enclosing surface of said ink chamber.

2. The ink spraying device as claimed in claim 1, further comprised of said separately formed ink spraying portion further comprising said ink chamber being pre-aligned with respect to the nozzle plate.

3. The ink spraying device as claimed in claim 1, further comprised of said separately formed ink spraying portion being fixed onto said separately formed ink heating portion using high-temperature, high-pressure bonding.

4. The ink spraying device as claimed in claim 1, further comprised of a membrane of said plurality of membranes of said membrane layer being formed of material having a coefficient of thermal expansion different from that of material forming any other membrane of said plurality of membranes of said membrane layer.

5. An ink spraying device for a print head, comprising:

a separately formed ink heating portion including a heating chamber, said separately formed ink heating portion producing thermal energy in accordance with an applied electric energy; and a separately formed ink spraying portion including an ink chamber, said separately formed ink spraying portion being assembled onto said separately formed ink heating portion, said separately formed ink spraying portion including a membrane layer formed of a plurality of membranes to separate said heating chamber from said ink chamber to form and eject ink droplets in accordance with the produced thermal energy, one membrane of said plurality of membranes of said membrane layer forming an enclosing surface of said heating chamber and another membrane of said plurality of membranes of said membrane layer forming an enclosing surface of said ink chamber.

6. The ink spraying device as claimed in claim 5, further comprised of said separately formed ink heating portion comprising:

a substrate;

a heating layer formed over said substrate;

a plurality of electrodes formed on said heating layer to supply electric energy to said heating layer; and a heating chamber barrier defining said heating chamber formed above said heating layer.

7. The ink spraying device as claimed in claim 6, further comprised of said substrate having a protective layer for protecting a surface of said substrate.

8. The ink spraying device as claimed in claim 6, further comprised of said substrate comprising silicon.

9. The ink spraying device as claimed in claim 6, further comprising an electrical contact formed on at least one of said plurality of electrodes.

10. The ink spraying device as claimed in claim 5, further comprising a passivation layer formed over said heating layer, said passivation layer protecting an interior of said separately formed ink heating portion from being damaged due to heat produced.

11. The ink spraying device as claimed in claim 10, further comprised of said passivation layer being comprised of a plurality of passivation layers.

12. The ink spraying device as claimed in claim 10, further comprised of said passivation layer being formed of one of silicon nitride ($Si_3N_4$), silicon carbide (SiC) and tantalum.

13. The ink spraying device as claimed in claim 5, further comprised of said separately formed ink spraying portion comprising:

a nozzle plate having an opening through which ink is sprayed; and an ink chamber barrier formed on said nozzle plate to define said ink chamber and correspond to the opening of said nozzle plate; and said membrane layer being formed adjacent said ink chamber barrier.

14. The ink spraying device as claimed in claim 13, further comprised of said nozzle plate being formed through a plating process.

15. The ink spraying device as claimed in claim 13, further comprised of said nozzle plate comprising nickel.

16. The ink spraying device as claimed in claim 13, further comprised of said separately formed ink heating portion comprising:

a substrate;

a heating layer formed over said substrate;

a plurality of electrodes formed on said heating layer to supply electric energy to said heating layer; and a heating chamber barrier defining said heating chamber formed above said heating layer.

17. The ink spraying device as claimed in claim 16, further comprised of a membrane of said plurality of membranes of said membrane layer being formed of material having a coefficient of thermal expansion different from that of material forming any other membrane of said plurality of membranes of said membrane layer.

18. The device as claimed in claim 5, further comprised of a membrane of said plurality of membranes of said membrane layer being formed of material having a coefficient of thermal expansion different from that of material forming any other membrane of said plurality of membranes of said membrane layer.

19. A method for forming an ink spraying device for a print head, comprising the steps of:

forming separately an ink heating portion including a heating chamber, said separately formed ink heating portion producing thermal energy in accordance with an applied electric energy;

forming separately an ink spraying portion including an ink chamber, and including forming a membrane layer of a plurality of membranes to separate said heating chamber from said ink chamber to form and eject ink droplets in accordance with the produced thermal energy; and assembling said separately formed ink spraying portion onto said separately formed ink heating portion so that one membrane of said plurality of membranes of said membrane layer forms and an enclosing surface of said heating chamber and another membrane of said plurality of membranes of said membrane layer forms an enclosing surface of said ink chamber.

20. The method as claimed in claim 19, further comprised of forming a membrane of said plurality of membranes of said membrane layer of material having a coefficient of thermal expansion different from that of material forming any other membrane of said plurality of membranes of said membrane layer.

21. The method as claimed in claim 19, further comprised of:

said step of forming separately said ink heating portion comprising the steps of:

forming a substrate;

forming a heating layer over said substrate;

forming a plurality of electrodes on said heating layer to supply electric energy to said heating layer; and forming above said heating layer a heating chamber barrier to define said heating chamber; and said step of forming separately said ink spraying portion further comprising the steps of:

forming a nozzle plate having an opening through which ink is sprayed; and forming an ink chamber barrier on said nozzle plate to define said ink chamber and to correspond to the opening of said nozzle plate, said membrane layer being formed adjacent said ink chamber barrier.

22. The method as claimed of claim 21, further comprised of forming a membrane of said plurality of membranes of said membrane layer of material having a coefficient of the thermal expansion different from that of material forming any other membrane of said plurality of membranes of said membrane layer.

* * * * *